United States Patent [19]

Grosz et al.

[11] Patent Number: 4,693,152

[45] Date of Patent: Sep. 15, 1987

[54] ROTARY TUBE PUNCHING ARRANGEMENT WITH TUMBLING PUNCH AND METHOD FOR PUNCHING HOLES INTO A FILM WEB

[75] Inventors: Edward G. Grosz, Sodus Point; Fox J. Herrington, Holcomb, both of N.Y.

[73] Assignee: Mobil Oil Corporation, New York, N.Y.

[21] Appl. No.: 871,334

[22] Filed: Jun. 6, 1986

[51] Int. Cl.[4] ..... B26D 7/14; B26D 7/18; B26F 1/08

[52] U.S. Cl. ..... 83/24; 83/18; 83/100; 83/337; 83/345

[58] Field of Search ..... 83/337, 327, 345, 100, 83/24, 18

[56] References Cited

U.S. PATENT DOCUMENTS

| | | | |
|---|---|---|---|
| 2,760,576 | 8/1956 | Spencer | 83/337 X |
| 3,147,656 | 9/1964 | Kwitek . | |
| 3,290,202 | 12/1966 | Pratt | 83/337 X |
| 3,483,780 | 12/1969 | Hudson . | |
| 3,550,494 | 12/1970 | Adams et al. . | |
| 3,680,419 | 8/1972 | Stoop . | |
| 3,728,918 | 4/1973 | Helm . | |
| 3,747,447 | 7/1973 | Wisner | 83/337 X |
| 4,218,944 | 8/1980 | Sclippa | 83/345 |
| 4,452,114 | 6/1984 | Rynik et al. . | |
| 4,480,516 | 11/1984 | Leroy . | |

*Primary Examiner*—Frank T. Yost

*Attorney, Agent, or Firm*—Alexander J. McKillop; Michael G. Gilman; Charles J. Speciale

[57] ABSTRACT

A method of accurately punching holes into a moving web of a thermoplastic film material, and more particularly, punching holes into the web through the intermediary of a rotary serrated tube punch. The invention relates to accurately punching holes into an advancing web of thermoplastic film material utilizing a novel rotary serrated tube punch. The film web is continuously advanced over at least a portion of the circumferential surface of a rotatable anvil roll, and tensioned against the anvil roll surface through the use of suitable tensioning devices, such as tension rollers arranged upstream and downstream of the anvil roll. At least one opening is formed in the circumferential surface of the anvil roll which is slightly larger than the size of the hole which is desired to be punched into the film web through the use of the inventive rotary tube punching arrangement. The rotary tube punch possesses a serrated cutting edge at its radially outermost end, and is adapted to be rotated in synchronism with the anvil roll and concurrently pivoted or tumbled, so as to cause the serrated cutting edge pierce through the web in a precisely aligned position with the opening in the rotating anvil roll, and to thereby produce an accurately dimensioned hole in the moving web without the necessity for stoping the web. The anvil roll may be constructed hollow, and communicates with a suctioning source for aspirating punched out film material segments.

22 Claims, 6 Drawing Figures

ROTARY TUBE PUNCHING ARRANGEMENT WITH TUMBLING PUNCH AND METHOD FOR PUNCHING HOLES INTO A FILM WEB

BACKGROUND OF THE INVENTION

1. Field of the Invention

The present invention relates to a method of accurately punching holes into a moving web of a thermoplastic film material, and more particularly, punching holes into the web through the intermediary of a novel and unique rotary serrated tumbling tube punch. Moreover, the invention also relates to accurately punching holes into a continuously advancing web of thermoplastic film material utilizing the novel rotary serrated tumbling tube punch, in which the cutting edge of the punch pierces the film web at a substantially right angle to the film surface to attain an enhanced degree of punching precision and accuracy.

In the production of various types of articles which are basically formed from a thermoplastic film material, such as polyethylene film or the like; for instance, articles such as plastic bags employed in supermarkets or plastic garbage disposal or trash bags, it is frequently necessary to provide holes in a web of the thermoplastic film material employed for the high-speed series production of the bags, which must be punched through at a high degree of accuracy with respect to the location of the holes in the film web and repetitions in successive hole patterns. Thus, for instance, with regard to plastic bags onto which tapes are to be applied and which are used for closing trash bags in the manner of a drawstring, and into which there must be punched holes in order to afford a consumer access to the tape for closing the bags, the inability of presently employed or available production equipment in providing accurately positioned and dimensioned holes necessitates wider border edges to be formed on the film web for the receipt of such tapes, with the consequence of requiring greater amounts of plastic material to be expended in the formation of the bags, thereby rendering current manufacturing methods less than optimally economical.

Thus, a somewhat definite need has arisen in the industry for more economical methods and configurations through webs of thermoplastic film material, in which the webs are conveyed in a continuously advancing mode between processing stations, so as to thereby afford optimized production rates and extremely high degrees of manufacturing accuracy, without the need to stop the continual advance of the film web during the hole punching procedure.

Heretofore, one particular method of punching holes through polyethylene film webs contemplated the use of hole punching apparatus incorporating a tube forming a die punch having a cutting edge consisting of serrations or sharpened teeth facing towards the film. For example, a punching apparatus of that type is disclosed in Adams, et al. U.S. Pat. No. 3,580,120. The serrated cutting edge of the punch is then pressed through the film web while the latter is in a stationary condition during the intermittent advance of the web and with the web being supported externally of the die punch in order to maintain the necessary tension on the film web during the hole punching operation. Thus, in order to employ a serrated punch for punching holes into a film web, in accordance with the state of the art, it is necessary to either advance the web only intermittently in order to prevent it from moving while the hole is being punched, or to reciprocate the punch so as to match the web speed when the latter is continually advanced, or to press the punch through the moving web and, as a result, produce a relatively ragged and inaccurate hole. Consequently, the prior art hole punching methods and apparatus for producing holes in plastic film webs are either complex in construction and/or cumbersome in use, and fail to provide the required accuracy in forming punched holes in a continuously advancing web of thermoplastic film material, so as to render them commercially viable or competitive.

2. Discussion of the Prior Art

Although rotary film web or sheet material punching devices are known in the technology, none of these devices are analogous to the arrangement pursuant to the present invention and in implementing the hole punching method as disclosed herein.

Stoop U.S. Pat. No. 3,680,419 discloses a rotary punch device in which a hollow rotating punch has a projecting cutting edge which is adapted to cut holes into a paper web advanced over an anvil roll, and wherein the chips which are punched out of the paper web are aspirated through the punch through the applying of a vacuum. This prior art device, however, fails to provide for tensioning a thermoplastic film web about the circumference of an anvil roll and the punching of holes therethrough by a serrated cutting edge on a punch analogous to that of the present invention, and thus would not be capable of providing the desired degree of accuracy in the punching of holes into a continuously advancing web of a thermoplastic film material.

Leroy U.S. Pat. No. 4,480,516 discloses a rotatable cutting device contacting an anvil or counter roll over which a film web is advanced by means of a cutter possessing a cutting edge for severing the web into predetermined sections. This does not allow for the formation of holes in an accurate manner analogous to that afforded by the device and method pursuant to the present device.

Helm U.S. Pat. No. 3,728,918 discloses a rotary panel cutter through the intermediary of which sections are cut out of a continuously advanced film web. However, there is no disclosure of a serrated cutter engaging into an opening in an anvil roll to punch accurately-sized holes into a film web analogous to that of the present invention.

Other prior art methods and apparatus direct themselves to trimming strips from a continuously moving film web, such as Rynik U.S. Pat. No. 4,452,114; or to a cam-actuated serrated tube punching device for punching a plurality of holes into a film web, as disclosed in Adams, et al. U.S. Pat. No. 3,550,494. Neither of these publications, nor the other above-described U.S. patents disclose a method and apparatus which enables the accurate punching of holes into a continuously advancing plastic film web.

SUMMARY OF THE INVENTION

An apparatus and method for the punching of accurately positioned holes into a continuously advancing plastic film web has already been successfully developed, and is the subject matter of copending Herrington U.S. patent application Ser. No. 798,518, filed Nov. 15, 1985, now U.S. Pat. No. 4,656,900, the disclosure of which is incorporated herein by reference, and which is commonly assigned to the assignee of this application.

In that disclosure, the cutting end of the serrated tube punch is fixedly attached at the radially outermost end of a rotatably arm, or fastened on the circumference of a rotatable disc member, and thereby initially pierces through the film web, which is supported on the surface of a cooperating anvil roll, with the leading edge of the cutting member and then towards the trailing edge thereof in a somewhat curvilinear or "rocking" motion. This curving piercing movement of the cutting teeth of the serrated tube cutter through the surface of the film web may produce an ovality or distortion in the hole being punched into the film web and to some extent, may not impart the desired hole size and/or configuration to the web commensurate with the size and slope of the tubular punch.

In order to still further improve upon the accuracy in the size of the holes being punched into a continuously advancing web of a plastic material, the present invention contemplates the incorporation of novel and unique operative structure into the arrangement for rotating and supporting the rotary tubular punch which will impart a pivoting or "tumbling" motion to the punch enabling it to punch through the film web at substantially right angles to a tangential line relative to the film surface of the web being conducted over the anvil roll, and perpendicular to the opening formed in the anvil roll for receiving the punch.

In essence, the present invention provides for a rotary serrated tumbling tube punching arrangement, in which a film web of a thermoplastic material is continuously advanced over at least a portion of the circumferential surface of a rotatable anvil roll which, if desired, may be hollow, and tensioned against the anvil roll surface through the use of suitable tensioning devices, such as tension rollers arranged upstream and downstream of the anvil roll. At least one opening is formed in the circumferential surface of the anvil roll which is slightly larger in size than the size of the hole which is desired to be punched into the film web through the use of the inventive rotary tumbling tube punching arrangement. A pivotable rotary tumbling tube punch possessing a serrated cutting edge at its radially outermost end, is adapted to be rotated and concurrently pivoted about a transverse axis in synchronism with the speed of rotation of the anvil roll so as to cause the serrated cutting edge to pierce through the web in a substantially perpendicularly aligned position relative the opening in the rotating anvil roll, and to thereby produce an extremely accurately dimensioned hole in the moving web without the necessity for stopping the web.

Furthermore, the speeds of rotation and diameters of rotation of the anvil roll and of the rotating punch may be correlated with respect to each other, wherein the circumference of the anvil roll about which the film web is transported is essentially equal to the repeat length of the hole locations which are to be punched through the film web, or equal to an integral fraction or multiple thereof. The serrated cutting edge of the punch, the latter of which may be mounted on a rotatable disc, supported on a pivotable elbow or rocker arm connected to the rotatable disc so as to impart a tumbling movement to the punch, rotates at a speed such that the cutting edge of the punch travels at the same linear speed of advance as the speed of the hole in the circumference of the anvil roll. The hole in the anvil roll is slightly larger than the size of the serrated cutting edge of the punch, with the surface of the anvil roll surrounding the hole supporting the film web, and thereby facilitating the accurate punching through of the film web by the cutting edge of the punch as the latter enters the hole in the anvil roll.

In accordance with the invention, the pivoting or tumbling action may be imparted to the serrated tube punch, and to the rocker arm or elbow member on which it is supported, through the intermediary of the belt drive arrangement which will ensure the positioning of the cutting edge of the punch in substantially perpendicular alignment with the hole in the anvil roll and surface of the film web during the punching sequence.

Pursuant to another aspect of the present invention, the serrated cutting edge on the punch and the hole in the anvil roll need not be necessary round in shape, but may be configured to punch holes in the film web which are of various shapes; such as, for example, elliptical, oval or even polygonally-shaped holes possessing accurate dimensions.

Accordingly, it is an object of the present invention to provide a unique rotary punching arrangement incorporating a rotary serrated tumbling tube punch engaging into a slightly larger opening provided in a rotatable anvil roll over the circumference of which there is tensioned a continuously advancing web of thermoplastic film material in order punch accurately-sized holes into the web without any distortion of the holes or the web material.

A more specific object resides in the provision of a rotary serrated tumbling tube punch which is rotated in synchronism with an anvil roll over which a thermoplastic film web is tensioned and which is pivoted through the interposition of a belt drive to be in substantial vertical alignment with the surface of the film web during the punching therethrough, so as to form accurately-sized and spaced holes in the film web.

Pursuant to another aspect of the invention, aspirating means is in communication with the interior of the anvil roll, the latter of which is of a hollow drum construction, for suctioning out the segments of the thermoplastic film web punched out by the serrated punch, and conveying the segments to suitable waste receiving or disposal means.

In accordance with still another object of the present invention, it is an object to provide a novel method for accurately punching holes into a continuously advancing thermoplastic film web utilizing the unique rotary serrated tumbling tube punch and anvil roll arrangement as described herein.

BRIEF DESCRIPTION OF THE DRAWINGS

Reference may now be had to the following detailed description of exemplary embodiments of the rotary and tumbling tube punching arrangement, taken in conjunction with the accompanying drawings; in which.

DETAILED DESCRIPTION

Figure 1:
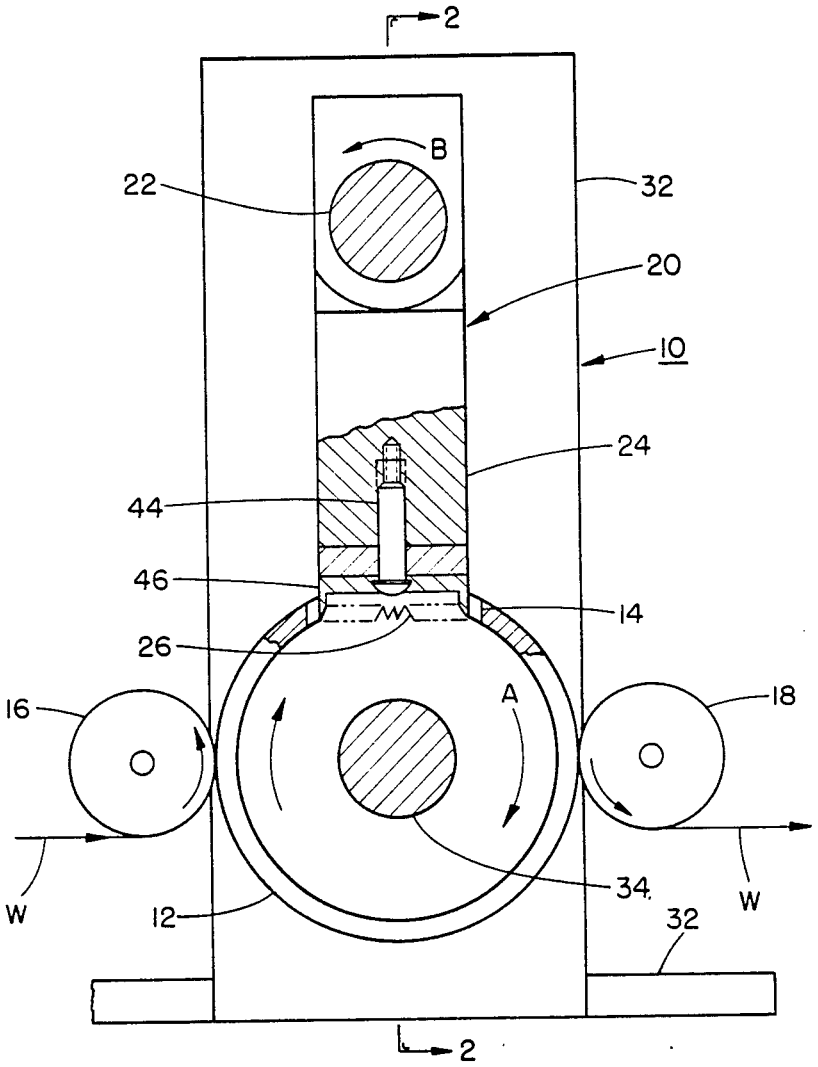
FIG. 1 PRIOR ART
FIG. 1 illustrates a schematic representation of an apparatus for punching holes in a continuously advancing film of a thermoplastic film web material.
Figure 2:
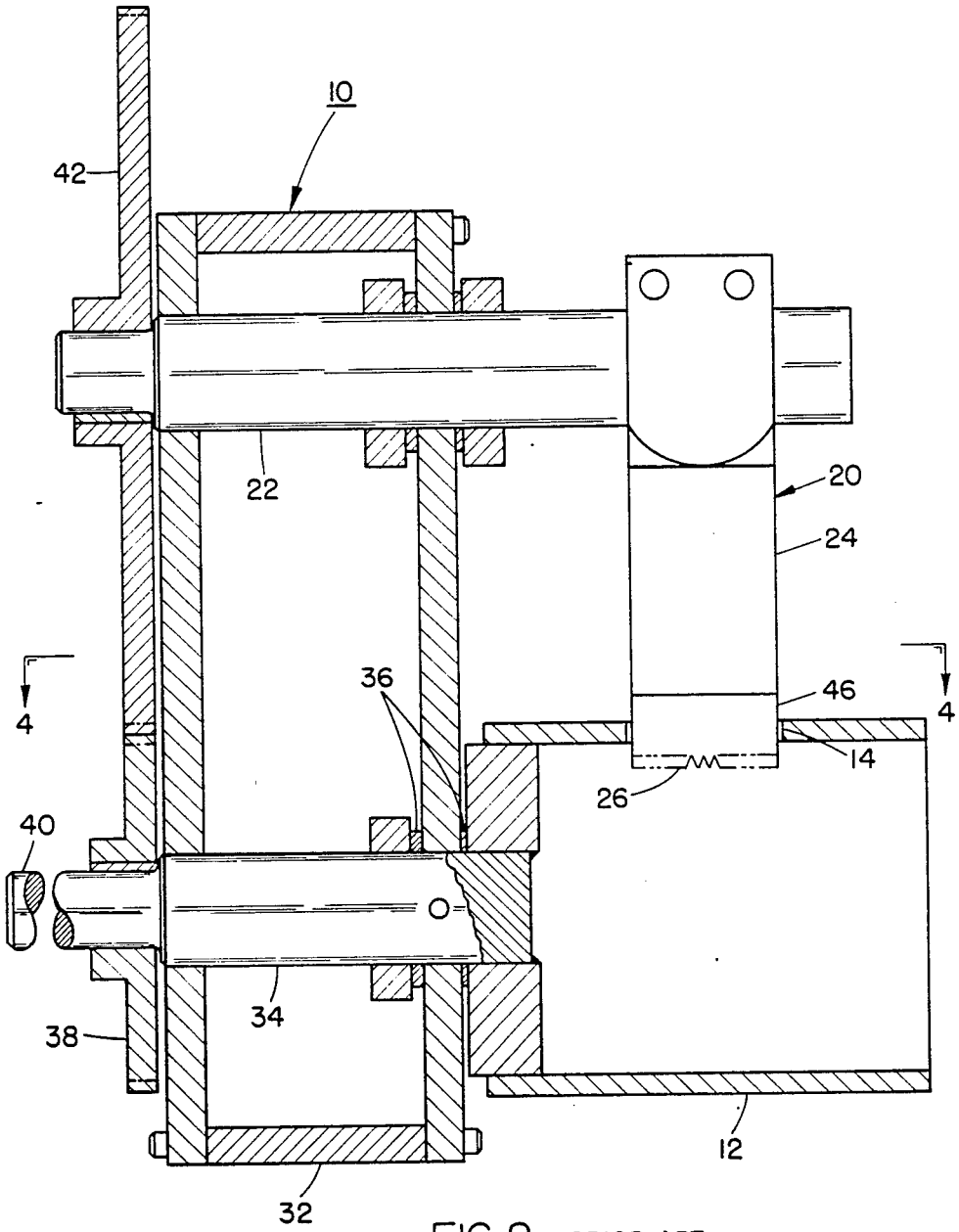
FIG. 2 PRIOR ART
FIG. 2 illustrates, partly in section, a side elevational view of an apparatus for punching holes in a continuously advancing web of a thermoplastic film material.

Referring to FIGS. 1 and 2 of the drawings, there is schematically illustrated the basic concept of a rotary die punching arrangement 10 for punching holes into a continuously advancing web W of a thermoplastic film material, for example, such as polyethylene film which is utilized in the production of plastic bags, trash disposal bags or the like, as described in more extensive detail in copending U.S. Pat. Ser. No. 798,518. The die punching arrangement 10 basically incorporates an anvil roll 12, which in this embodiment is preferably but not necessarily of a hollow drum-like construction, and which has a punch-receiving opening 14 formed in its circumferential surface. A pair of freely-rotatable tension rollers 16 and 18 are positioned respectively one each upstream and downstream of the anvil roll 12, preferably in surface contact therewith, along which there is conducted the film web W such that the rollers 16, 18 form tensioning guides for the web W as the web is being conducted over the circumferential surface of the anvil roll 12, to maintain the film thereon in a predetermined tensioned condition. The anvil roll 12 is rotated through a suitable drive in the direction of arrow A, while concurrently therewith a die punch arrangement 20 is rotated in the counter-rotatable direction of arrow B in predetermined synchronism therewith. The die punch arrangement 20 includes a rotatable shaft member 22 which may be driven in synchronism therewith with the anvil roll 12 by being either geared or belted therewith, as detailed in FIG. 2, and incorporates a radially extending tubular die punch 24 which, at its free end, has a serrated cutting edge 26 adapted to project into the punch-receiving opening 14 in the circumference of the anvil roll so as to cause the die punch 24 to punch a hole into the film web W.

The tensioning of the film web W by the tensioning rollers 16, 18 will ensure that the hole which is punched therein by the rotatable punch 24 is accurately dimensioned and not distorted by any shifting of the film web on the anvil roll surface as it is being punched.

Referring to FIG. 2 of the drawings, the die punching arrangement 10 has the anvil roll 12 rotatably supported from a stationary frame structure 32, which roll may be a closed-ended hollow drum constituted of a suitable metal, such as steel or the like. Projecting coaxially from one end of the anvil roll 12 is a shaft 34 which is fixed thereto, which is rotatably journalled in suitable bearings 36 provided in the stationary frame structure 32, and which shaft mounts a spur gear 38 at its free end 40. The circumferential surface of the anvil roll 12 is provided with at least one through opening 14 of predetermined size for receiving a die punch cutter. The rotary punching device 20 consists of the arm member 24 which, at one end thereof, is fixedly clamped to the rotatable shaft 22 which is journalled in the frame structure 32, and which extends in parallel spaced relationship with the shaft 34. A spur gear 42 fastened to the other end of the shaft 22 is in driving interengagement with the spur gear 38 such that both shafts 34, 22 may be counter-rotated in predetermined synchronism by a suitable driving arrangement (not shown).

Fastened to the opposite free end of the arm member 24 of the punching device 20, such as by a screw fastening 44, is an annular cup-shaped, or sleeve-like cutter 46 having the serrated or toothed cutting edge 26 facing towards the circumferential surface of the anvil roll 12.

The relative rotational movement between the arm member 24 and that of the anvil roll 12 is correlated and synchronized, for example, by the ratio of the pitch diameters of the interengaged gears 38, 42; the radius of rotation of the cutter 46 about its shaft 22, and the diameter of the anvil roll 12. This then will ensure that the leading teeth of cutting edge 26 will initially pierce through the film web W and enter the opening 14 formed in the circumferential surface of the anvil roll 12, and thereafter the remaining teeth in sequence, which may lead to some distortions and adversely affect the accuracy in size and shape of the holes in the film web.

In the inventive construction of a die punching arrangement 50 pursuant to the generally diagrammatic representation in FIGS. 3 to 6 of the drawings, the arrangement incorporates a novel and unique tumbling or pivotable tubular punching device 52 which will ensure that all of the teeth forming the cutting edge of the punching device will pierce the film web W practically simultaneously at substantially right angles or normal orientation relative to the film web surface, thereby increasing the degree of accuracy in the size and shape of the hole punched into the film web.

Figure 3:
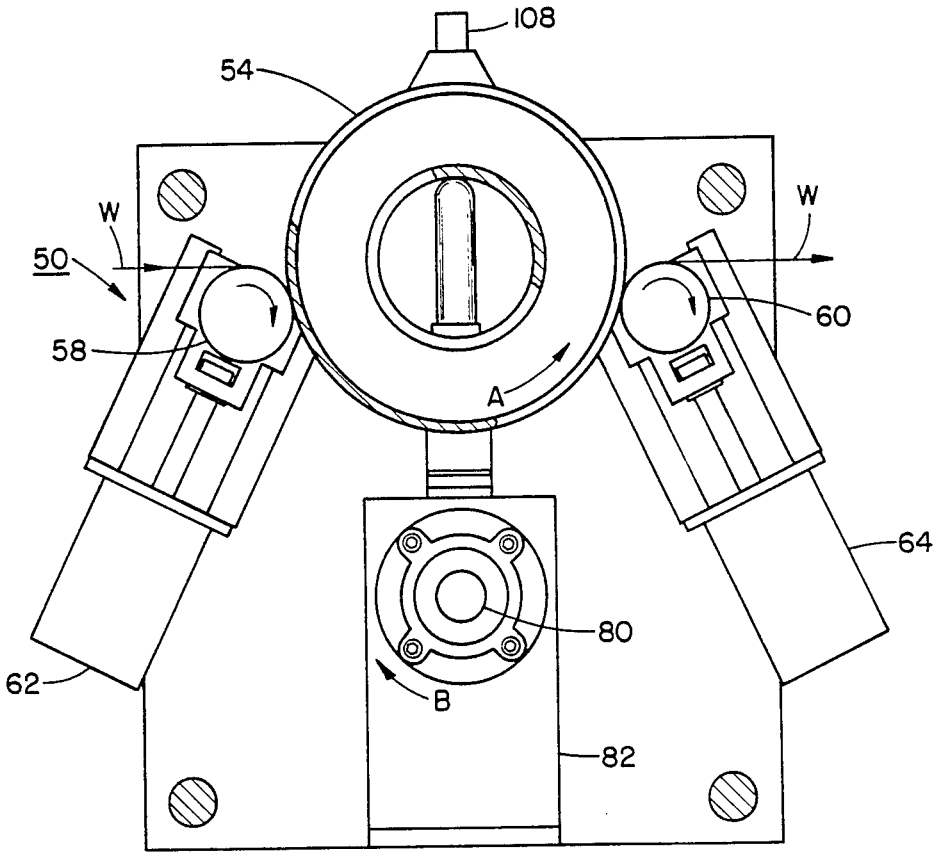
FIG. 3 illustrates, generally diagrammically, a front elevational view of the apparatus incorporating the inventive tumbling punch structure.
Figure 4:
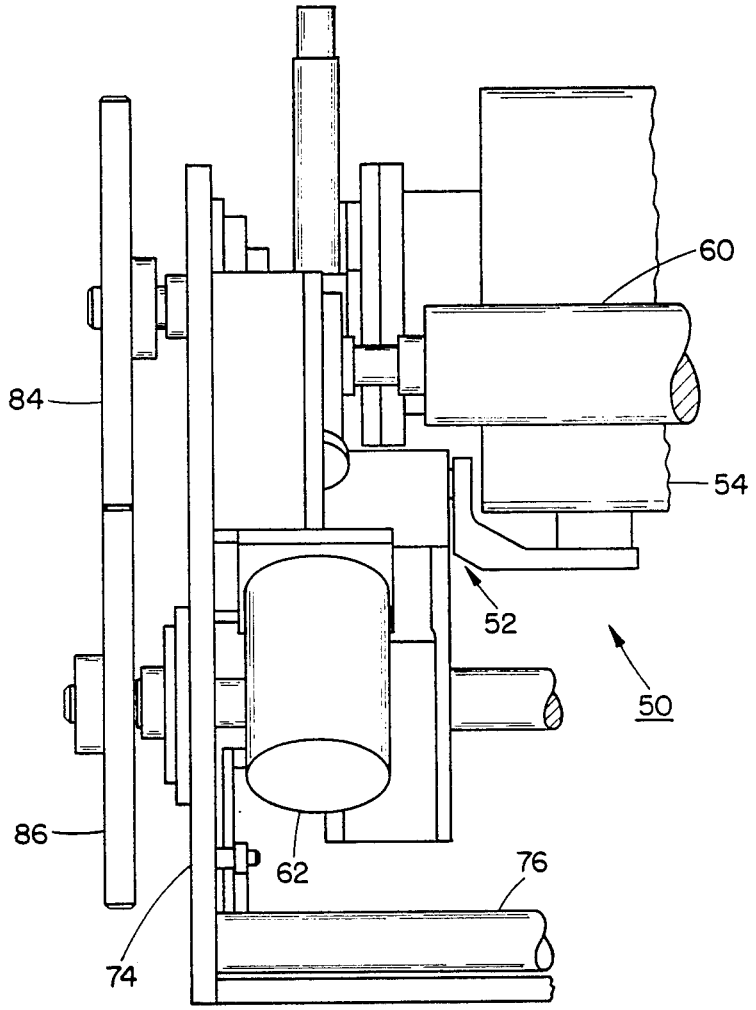
FIG. 4 illustrates a side elevational view of the apparatus of FIG. 3.
Figure 6:
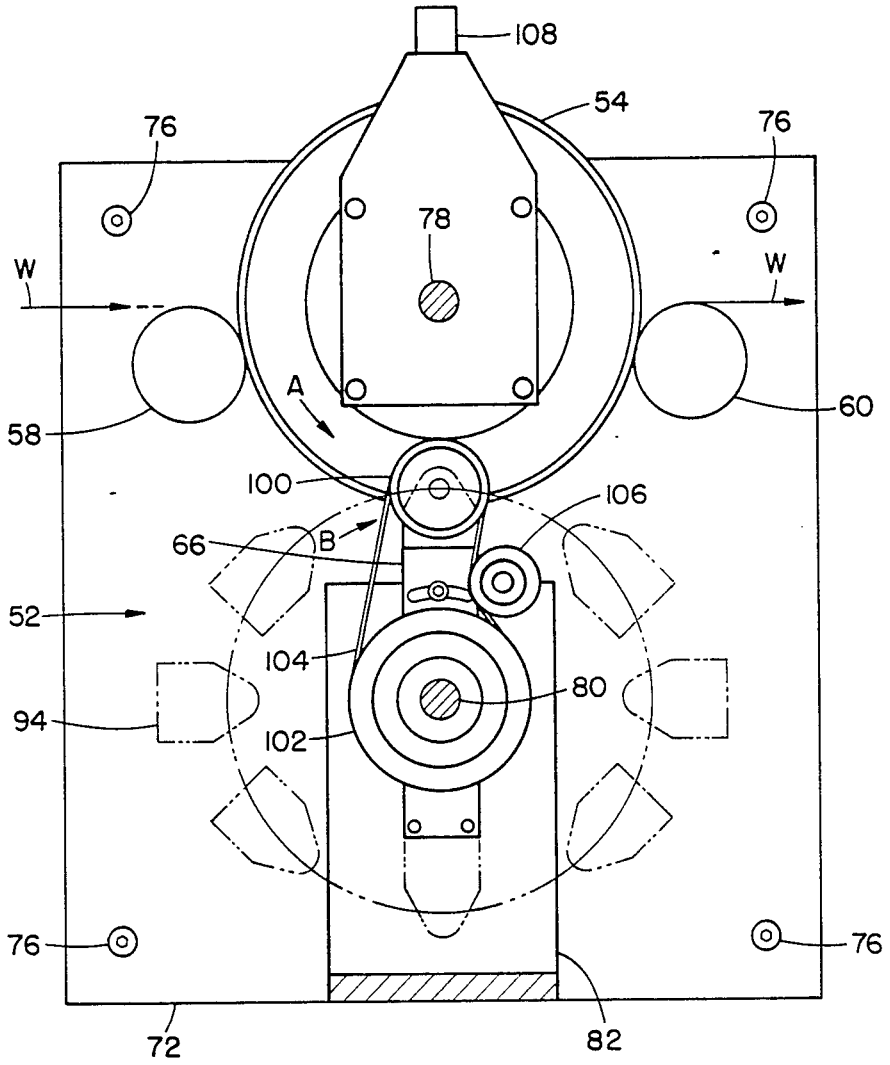
FIG. 6 is a sectional view taken along line 6—6 in FIG. 5.

As may be readily ascertained from the drawings, an anvil roll 54 which, in this embodiment, is a hollow closed-ended drum and which has a punch receiving opening 56 provided therein it its circumferential surface, has a pair of freely-rotatable tension rollers 58 and 60 arranged, respectively, upstream and downstream thereof. Suitable biasing devices 62 and 64, which may be either spring-loaded pusher members, pneumatic or hydraulically-operated pistons or the like, will cause the tension rollers 58 and 60 to each be biased into surface contact with the circumference of the anvil roll 54, as is clearly illustrated in FIGS. 3 and 4 of the drawings. This surface contact between the rotatable tension rollers 58 and 60, and the anvil roll 54, will cause the thermoplastic film web W which is being conveyed along the direction of the arrow, as shown in FIG. 3, to be maintained under tension as the web is conducted over the circumferential surface of the anvil roll 54 rotating in the direction of arrow A, so as to maintain the film web thereon in a predetermined surface-contacting tensioned condition. The anvil roll 54 is driven through a suitable drive arrangement, described in further detail hereinbelow, in the direction of arrow A while, concurrently therewith, a rotatable arm 66, which forms a part of the punching device 52, is rotated in the direction of arrow B as shown in FIGS. 3 and 6. The rotatable arm 66 supports the tubular punch unit 68 in a manner and orientation relative to the opening 56 in anvil roll 54, as is described in further detail hereinbelow.

The entire arrangement is supported through the intermediary of a stationery frame structure 70, similar to frame structure 32 of FIG. 1, and comprises suitable upstanding support plates 72, 74 which are interconnected by transverse rods and/or support beams 76.

Figure 5:
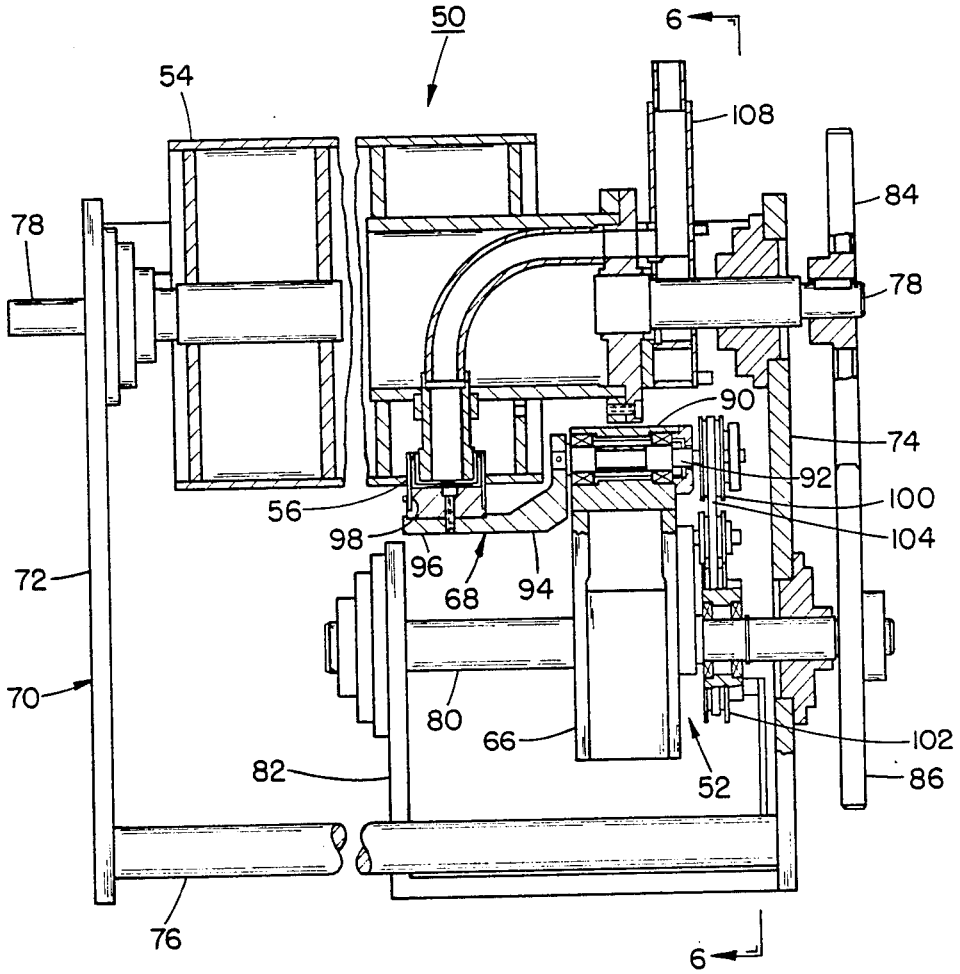
FIG. 5 illustrates a transverse sectional view through the apparatus of FIG. 3, showing internal details thereof.

Rotatably journalled in suitable support bearings in the plates 72 and 74, is a shaft 78, consisting of axially spaced shaft sections having the anvil roll 54 fastened coaxially therebetween to form an integral or unitary structure therewith. Similarly, the arm 66 of the rotary punching device 52 is rotatably journalled on a shaft 80 which is rotatably supported by suitable bearing in the plate 74 and another upright plate 82 of the frame structure 70 intermediate plates 72 and 74, and which shaft 80 is in parallel spaced relationship with the shaft 78. As illustrated in FIG. 5 of the drawings, a gear 84 fastened to one end of shaft 78 is operative interengagement with a gear 86 fastened to the end of the shaft 80 in the same plane therewith, so as to enable the anvil roll 54 and the arm 66 to be rotated, respectively, in the directions of arrows A and B at predetermined rotational speeds by a suitable drive (not shown).

A radial extension 90 is provided at one location along the extent of the arm 66, within which there is rotatably supported, on suitable bearings, a shaft 92 extending through the extension 90 of arm 66 in parallel spaced relationship with the shafts 78 and 80, and with the opposite ends of the shaft 92 projecting from both side wall surfaces of the arm 66.

The tubular punch unit 68 is supported at one end of the shaft 92, so as to be in radial alignment with the opening 56 in anvil roll 54, and is constituted of an angle bracket 94 having a first flange portion fastened to the end of shaft 92, and a second flange portion 96 extending perpendicularly away from the arm 66. Fastened to a surface of the flange portion 96, such as by a screw fastener, is a cup-shaped punching cutter 98 having a serrated or to toothed cutting edge which is adapted to radially enter the opening 56 in the circumference of the anvil roll 54.

The opposite end of the shaft 92 projecting from the other side of the arm 66 has a belt pulley 100 fastened thereon, and which is in operative driving engagement with a pulley 102 fastened in alignment therewith on the shaft 80 through the intermediary of a belt 104 entrained over the pulleys. The belt 104 is maintained tensioned by a further pulley 106 fastened to the arm 66 intermediate the pulleys 100, 102.

As the arm 66 rotates, its shaft 80 will concurrently turn within the stationary pulley 102, while the shaft 92 and the pulley 100 thereon, is swung about a circular path the center of which extends along the axis of shaft 80 so as to impart a pivoting or "tumbling" movement to the angle bracket 94 mounted on shaft 92. Through suitable correlation in the diameters of the pulleys 102 and 100, it is possible to ensure that when the punching unit 68 is rotated into radial alignment with the opening 56 in the anvil roll 54, the serrated cutting edge of the tubular punching cutter 98 will be oriented radially towards the opening 56 in the anvil roll 54, and at right angles or normal to the plane of the surface of the film web W passing over the opening 56 so as to cause all teeth or serrations of the cutting edge to simultaneously pierce through the film web W in a substantially perpendicular manner, with only the slightest possible pivoting movement being imparted to the punching device 52 during the hole punching procedure.

In the case when the pulleys 100 and 102 are imparted diameters which are equal in size, the axis of the rotatable serrated tubular punching cutter 98 will remain oriented so it always points in the same direction, and the punch will move like the chairs of a ferris wheel. However, if the pulley 102 on the shaft 80 is a multiple of the diameter of the pulley 100 on the shaft 92, then the serrated tubular punching cutter 98 which is fastened to the surface of the flange portion 96 of angle bracket 94 will tumble backward relative to the rotation of the arm suspended by the belt 104. Thus, for example, if the pulley 102 mounted on shaft 80 has three times the diameter of the pulley 100 on the shaft 92, then a 10° counter-clockwise rotation will result in a clockwise rotation of the tubular punching cutter 98 by 30° relative to the belt drive, which produces a 20° absolute clockwise rotation; therefore, when the pulley arrangement moves to a full revolution, the punching device tumbles backward twice.

On the other hand, if the anvil 54 has a circumference which is one-half the repeat length of the punch, then the gear drive for the punch will produce one revolution of arm 66 for each two revolutions of anvil roll 54, and if the anvil roll 54 rotates clockwise 20° then the punch arm rotates counter-clockwise 10° and the punch rotates clockwise 20°, which maintains its axis in parallel with the axis of the hole 56 in the anvil roll 54. Through proper selection of the centered spacing of the punch reach relative to the arm, it is possible to cause the punching cutter 98 to move into and out of the hole 56 at only relatively small and negligible positional deviation.

Within the hollow anvil roll 54, and communicating with the opening 56, there may be arranged a conduit 108 which connects to a suitable suctioning device (not shown) for aspirating away the punched out film discs or segments produced during the film punching operation.

From the foregoing, it clearly appears that the invention is directed to an extremely simple rotary die punching arrangement for accurately punching holes through a continuously advancing film of a thermoplastic web material, wherein the holes in the web may be spaced as required depending upon the proportional diameters and speeds of rotation of the anvil roll and the pivoting or tumbling motion of the rotary die punch, while concurrently permitting the punching of holes of configurations which are other than round into the web.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A rotary die punching arrangement for punching holes into a continuously advancing thermoplastic film web, comprising:

(a) a rotatable anvil roll having said film web extending in surface contact with at least a portion of the circumference of said roll; at least one opening of predetermined size being formed in the circumferential surface of said anvil roll;

(b) a rotatable arm; means mounting a rotary punch on a side of said arm for controllably pivoting said punch relative to said arm about an axis extending in parallel spaced relationship with the axis of rotation of said arm, said rotary punch having a tubular serrated cutting edge adapted to pierce said film web and enter said opening in said anvil roll at substantially right angles to the surface of said film web responsive to the pivoting of said punch;

(c) means for rotating said rotatable arm and concurrently pivoting said rotary punch, and means for imparting rotation to said anvil roll;

(d) and means for synchronizing the rotational movements of said anvil roll and said rotatable arm and the pivoting of said rotary punch as said film web advances over said opening on the anvil roll facing said punch whereby said serrated cutting edge punches a hole into said web upon radially entering said opening in said anvil roll.

2. An arrangement as claimed in claim 1, wherein said opening in said anvil roll is slightly larger than the diameter of said punch.

3. An arrangement as claimed in claim 1, comprising a stationary frame structure, said means for rotating said rotatable arm being a first shaft rotatably journalled on said frame structure; said means for rotating said anvil roll being a second shaft rotatably journalled on said frame structure; and said means for synchronizing the rotational movements of said rotatable and said anvil roll including means operatively interconnecting said first and second shafts.

4. An arrangement as claimed in claim 3, wherein said means operatively interconnecting said first and second shafts comprises interengaged driving gears fastened to the ends of said shafts for rotating said shafts at predetermined counter-rotating speed ratios.

5. An arrangement as claimed in claim 3, comprising a third shaft rotatably journalled in said rotatable arm in parallel spaced relationship with said first shaft, said third shaft being arranged proximate one end of said arm and extending from the opposite sides of said arm; a stationary first pulley being secured against rotation on said first shaft adjacent one of said arm sides, a second pulley being fixedly mounted on the end of said third shaft on said arm side; drive belt means engaging said pulleys for rotating said third shaft in response to the rotation of said arm about said first shaft; and means supporting said rotary punch being mounted on the end of said third shaft on the opposite side of said arm for orienting the serrated cutting edge of said punch in perpendicular alignment with the opening in said anvil roll during approach of said punch and upon the piercing of said film web and retracting of said punch therefrom.

6. An arrangement as claimed in claim 5, wherein said means mounting said rotary punch comprises an angle bracket having a first flange portion fastened to said third shaft, and a second flange portion supporting said rotary punch.

7. An arrangement as claimed in claim 6, wherein said rotary punch is detachably fastened through a screw fastener to said second flange portion so as to be exchangeable with another rotary punch.

8. An arrangement as claimed in claim 1, wherein said anvil roll comprises a hollow cylindrical drum, said punch-receiving opening extending through the wall of said roll.

9. An arrangement as claimed in claim 8, comprising suctioning means communicating with the interior of said hollow anvil roll for aspirating the segments of said film web punched out by said rotary punch.

10. An arrangement as claimed in claim 1, comprising means for tensioning said film web during the advance of said web along the circumferential surface of said anvil roll.

11. An arrangement as claimed in claim 10, wherein said film web tensioning means comprise first and second freely-rotatable tensioning rollers, one said tensioning roller being positioned upstream of said anvil roll and the other said tensioning roller being positioned at the downstream side of said anvil roll, said film web being entrained over said tensioning rollers during advance thereof.

12. An arrangement as claimed in claim 11; comprising means for biasing said tensioning rollers into surface contact with said anvil roll.

13. A method for punching holes into a continuously advancing thermoplastic film web, comprising:

(a) advancing said film web over a rotatable anvil roll with said film web extending in surface contact with at least a portion of the circumference of said roll; at least one opening of predetermined size being formed in the circumferential surface of said anvil roll;

(b) causing a rotary punch having a serrated cutting edge at the radially outer end thereof to pierce said film web at right angles to the surface of said web and to enter said opening in said anvil roll at predetermined intervals at a substantially radial motion relative to the anvil roll;

(c) rotating a rotatable arm mounting said rotary punch while concurrently pivoting said rotary punch to effect the radial orientation of said punch while piercing the film web; and rotating said anvil roll in conjunction with the rotation;

(d) and synchronizing the rotational movements of said anvil roll and said arm and the pivoting of said rotary punch with said film web advancing over said opening on the anvil roll facing said punch whereby said serrated cutting edge punches a hole into said web while radially entering said opening in said anvil roll.

14. A method as claimed in claim 13, wherein said opening in said anvil roll is slightly larger than the diameter of said punch.

15. A method as claimed in claim 13, comprising rotating said rotatable arm on a first shaft rotatably journalled on a stationary frame structure; rotating said anvil roll on a second shaft rotatably journalled on said frame structure; pivoting said rotary punch on a third shaft rotatably journalled in said arm in coaxially spaced relationship with said first shaft; and synchronizing the rotational movements of said rotatable arm and anvil roll and the pivoting motion of said rotary punch by operatively interconnecting said first and second shafts, and said first and third shafts.

16. A method as claimed in claim 15, comprising operatively interconnecting said first and second shafts by interengaged driving gears fastened to the ends of said shafts for rotating said shafts at predetermined counter-rotating speed ratios.

17. A method as claimed in claim 16, comprising operatively interconnecting said first and third shafts by a belt drive engaging pulleys fastened on said shafts.

18. A method as claimed in claim 17, comprising mounting said rotary punch on an angle bracket fastened to an end of said third shaft which is opposite the end to which one of said pulleys is fastened.

19. A method as claimed in claim 13, wherein said anvil roll is a hollow drum, comprising suctioning the interior of said hollow anvil roll for aspirating the segments of said film web punched out by said rotary punch.

20. A method as claimed in claim 13, comprising tensioning said film web during the advance of said web along the circumferential surface of said anvil roll.

21. A method as claimed in claim 20, comprising tensioning said film web over first and second freely-rotatable tensioning rollers, one said tensioning roller being positioned upstream of said anvil roll and the other said tensioning roller being positioned at the downstream side of said anvil roll, and entraining said film web over said tensioning rollers during advance thereof.

22. A method as claimed in claim 21, comprising biasing said tensioning rollers into surface contact with said anvil roll.

* * * * *